US006526254B2

(12) United States Patent
Futagawa

(10) Patent No.: US 6,526,254 B2
(45) Date of Patent: Feb. 25, 2003

(54) IMAGE FORMING APPARATUS WITH SHEET TRANSPORT SPEED CONTROLS TO REDUCE NOISE

(75) Inventor: Jiro Futagawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/883,319

(22) Filed: Jun. 19, 2001

(65) Prior Publication Data

US 2002/0001494 A1 Jan. 3, 2002

(30) Foreign Application Priority Data

Jun. 30, 2000 (JP) ..... 2000-199948

(51) Int. Cl.[7] ..... G03G 15/00
(52) U.S. Cl. ..... 399/396
(58) Field of Search ..... 399/68, 381, 388, 399/394, 396; 347/156; 271/9.01, 9.11, 9.13, 188, 262, 272, 273

(56) References Cited

U.S. PATENT DOCUMENTS 4,416,534 A * 11/1983 Kluger ..... 399/396
5,563,696 A 10/1996 Futagawa et al. ..... 399/69
5,629,762 A * 5/1997 Mahoney et al. ..... 399/364
5,742,867 A * 4/1998 Kodama ..... 399/396 X
6,014,542 A * 1/2000 Hozumi et al. ..... 399/394
6,148,172 A * 11/2000 Kanda et al. ..... 399/391
6,160,973 A * 12/2000 Mui ..... 399/68

* cited by examiner

*Primary Examiner*—Hoan Tran
(74) *Attorney, Agent, or Firm*—Fitzpatrick, Cella, Harper & Scinto

(57) ABSTRACT

An image forming apparatus which can suppress the occurrence of noises without reducing productivity. Sheet transporting units are provided in a paper supply transport section for transporting a sheet to an image forming section, and in a paper ejection transport section for transporting the sheet, on which an image has been formed in the image forming section, to a paper ejection section. When an image is formed on a predetermined sheet, a speed control unit controls a sheet transport speed of at least one of the sheet transporting units provided in the paper supply transport section and the paper ejection transport section to be higher than that in the image forming section.

19 Claims, 7 Drawing Sheets

IMAGE FORMING APPARATUS WITH SHEET TRANSPORT SPEED CONTROLS TO REDUCE NOISE

BACKGROUND OF THE INVENTION

1. Field of the Invention

The present invention relates to an image forming apparatus, and more particularly to an apparatus which controls the transport speed of a sheet.

2. Description of the Related Art

FIG. 7 shows the construction of a conventional image forming apparatus. Referring to FIG. 7, numeral 1 denotes an image forming section for forming an image through an electrophotographic process. The image forming section 1 comprises a photoconductive drum 10, a laser scanner 9 for illuminating light to the surface of the photoconductive drum 10 to form an electrostatic latent image on it, and a developing station 11 for developing the latent image formed on the photoconductive drum 10.

Also, numeral 2 denotes a cassette for accommodating sheets of recording paper 3, and numeral 6 denotes a paper supply transport section for feeding the sheets of recording paper 3 to the image forming section 1 one by one. The paper supply transport section 6 comprises a reversing guide 7 for introducing the recording paper 3 to the image forming section 1 in a reversed state, register rollers 8 for correcting a skew of the recording paper 3. Numeral 14 denotes a paper ejection transport section for transporting the recording paper 3, on which an image has been formed in the image forming section 1, to a paper ejection tray 17 that serves as a paper ejecting section. The paper ejection transport section 14 comprises a reversing guide 15 and a paper ejection roller 16 for introducing the recording paper 3 to the paper ejection tray 17.

When an image is formed in the image forming apparatus thus constructed, one of the sheets of recording paper 3 accommodated in the cassette 2 is first picked up by a pickup roller 4 and then separated by a separator 5 for feeding to the paper supply transport section 6. Then, the recording paper 3 passes the reversing guide 7 and is introduced to the image forming section 1 after a skew of the recording paper 3 has been corrected by the register rollers 8.

Subsequently, when the recording paper 3 passes a top sensor 18 disposed immediately upstream of the image forming section 1, the laser scanner 9 for the image forming section 1 starts operation in synchronization. The laser scanner 9 irradiates a laser beam onto the photoconductive drum 10 to form an electrostatic latent image thereon. Then, the electrostatic latent image is developed into a visible image and transferred to the recording paper 3 in a transferring station 12.

After the transfer of the visible image, the recording paper 3 is guided to a fusing station 13 by a guide 19. The visible image is fused and fixed in the fusing station 13 under heating and pressure, whereby the image formation is completed. Then, the recording paper 3 is advanced to the paper ejection transport section 14 and ejected onto the paper ejection tray 17 by the paper ejection roller 16 after passing the reversing guide 15.

In such a conventional image forming apparatus, efforts have been made to transport the recording paper 3 at a sheet transport speed in the paper supply transport section 6 and the paper ejection transport section 14 about twice that in the image forming section 1, i.e., a process speed, for the purpose of reducing a fast copying time.

However, efforts at increasing the sheet transport speed have caused problems. When outputting 20 copies of the same original document successively, for example, an increase of the sheet transport speed in the paper supply transport section 6 and the paper ejection transport section 14 generates increased noise due to an increase in frictionally sliding sounds between the recording paper 3 and the reversing guides 7, 15, to collision sounds generated due to backlashes in engagement between gears at the time of start and stop, to collision sounds from clutches for transmitting torques to transport rollers, to sounds occurring when the recording paper 3 strikes against the register rollers 8 when a skew of the recording paper 3 is compensated for, and to sounds occurring when the recording paper 3 strikes against the reversing guide 7 when the recording paper 3 is looped. In particular, when the reversing guides 7, 15 are curved as shown in FIG. 7, the frictionally sliding sounds between the recording paper 3 and the reversing guides 7, 15 become more noticeable.

Further, a larger current must be supplied to each motor, etc., for achieving increased speed. This necessarily increases the amount of heat generated by the motor and raises motor temperature. Such increase of motor temperature not only deteriorates reliability of the motor itself, but also raise a temperature in the apparatus body. This temperature rise in the apparatus body causes an adverse effect upon the image forming section.

A fan or the like may be used to cool the image forming section for suppressing the adverse effect due to such a temperature rise. This case however would increase the costs. In the case of slowing down the sheet transport speed for the same purpose, overall productivity (time required for completion of a print) would be reduced.

SUMMARY OF THE INVENTION

In view of the state of the art set forth above, it is an object of the present invention to provide an image forming apparatus capable of suppressing noise without reducing productivity.

To achieve the above object, according to one aspect of the present invention, there is provided an image forming apparatus comprising an image forming section, a paper supply transport section for transporting a sheet to the image forming section, and a paper ejection transport section for transporting the sheet, on which an image has been formed in the image forming section, to a paper ejection section, the apparatus further comprising a sheet transporting unit provided in each of the paper supply transport section and the paper ejection transport section; and a speed control unit for controlling sheet transport speeds of each of the sheet transporting units, the speed control unit controlling the sheet transport speed of at least one of the sheet transporting units provided in the paper supply transport section and the paper ejection transport section to be higher than the sheet transporting speed in the image forming section when an image is formed on a predetermined sheet.

Also, according to the present invention, an image forming apparatus comprises an image forming section, a paper supply transport section for transporting a sheet to the image forming section, a sheet transporting unit provided in the paper supply transport section, and a speed control unit for controlling a sheet transport speed of the sheet transporting unit, the speed control unit controlling the sheet transport speed of the sheet transporting unit provided in the paper supply transport section to be higher than a sheet transporting speed in the image forming section during image formation.

Further, according to the present invention, the predetermined sheet is the last or first one when images are successively formed on a plurality of sheets.

Still further, according to the present invention, each sheet transporting unit is driven by a stepping motor, and the speed control unit controls the sheet transport speed of each sheet transporting unit by controlling the respective stepping motor.

Still further, according to the present invention, the paper supply transport section or the paper ejection transport section includes a curved sheet transport path.

Still further, according to the present invention, the image forming apparatus further comprises a re-transport section for transporting a sheet, on one side of which an image has been formed, back to the image forming section for forming an image on the other side of the sheet having the image formed on one side thereof; and a sheet transporting unit provided in the re-transport section, the speed control unit controlling the sheet transport speed of the sheet transporting unit provided in at least one of the re-transport section, the paper supply transport section and the paper ejection transport section to be higher than the sheet transport speed in the image forming section during image formation on the other side of the last sheet.

Still further, according to the present invention, a paper ejecting unit for ejecting a sheet to the paper ejection section is provided in the paper ejection transport section, and the speed control unit controls the paper ejecting unit to eject the sheet at a predetermined sheet ejection speed regardless of the sheet transport speed in the paper ejection transport section.

Thus, according to the present invention, the sheet transporting units are provided in the paper supply transport section for transporting a sheet to the image forming section, and in the paper ejection transport section for transporting the sheet, on which an image has been formed in the image forming section, to the paper ejection section. When an image is formed on a predetermined sheet, the speed control unit controls the sheet transport speed of at lease one of the sheet transporting units provided in the paper supply transport section and the paper ejection transport section to be higher than that in the image forming section.

Further objects, features and advantages of the present invention will become apparent from the following description of the preferred embodiments with reference to the attached drawings.

DESCRIPTION OF THE PREFERRED EMBODIMENTS

An embodiment of the present invention will be described below in detail with reference to the drawings.

Figure 1:
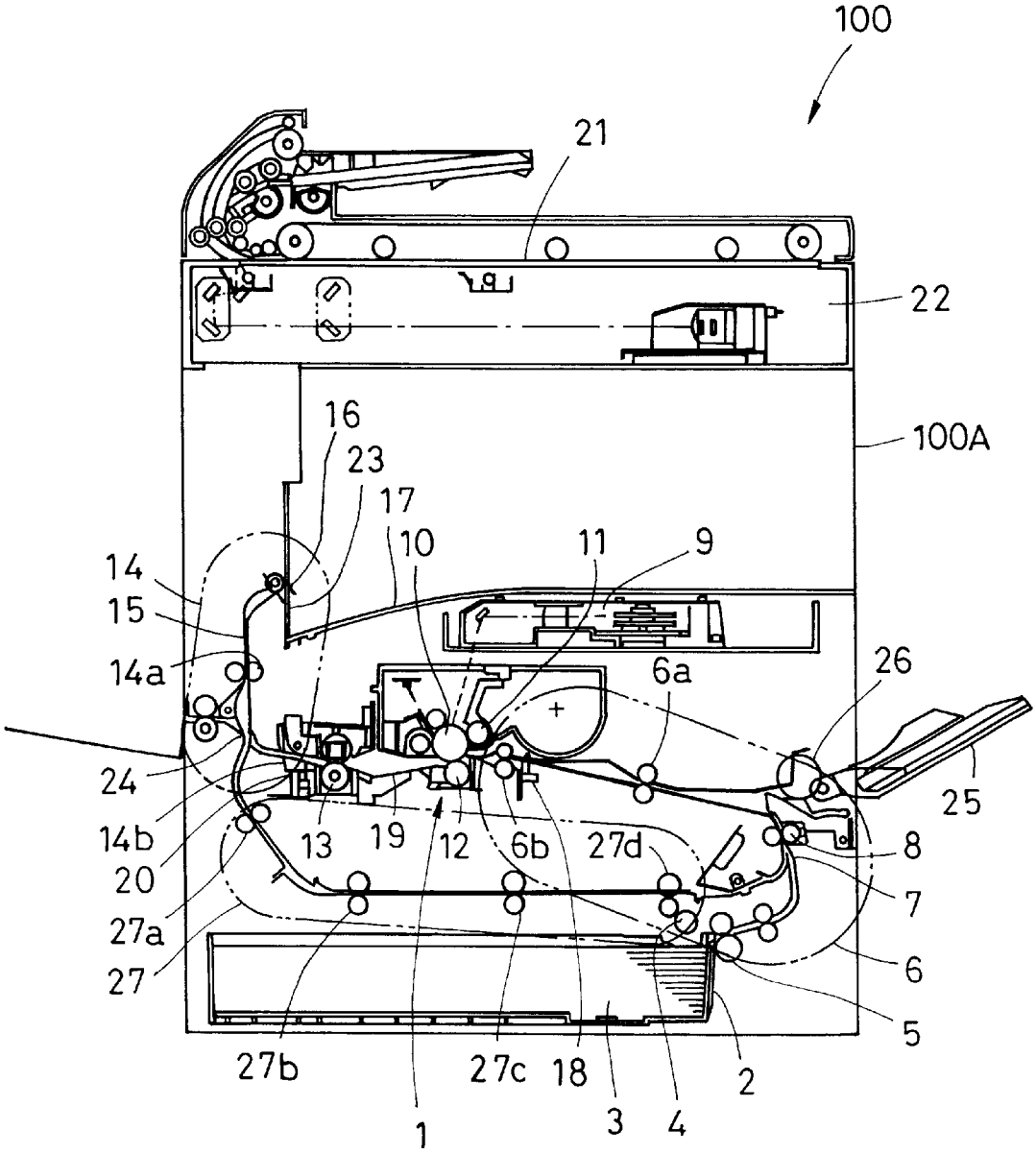
FIG. 1 is a view schematically showing the construction of a copying machine as one of image forming apparatus according to an embodiment of the present invention.
Figure 7:
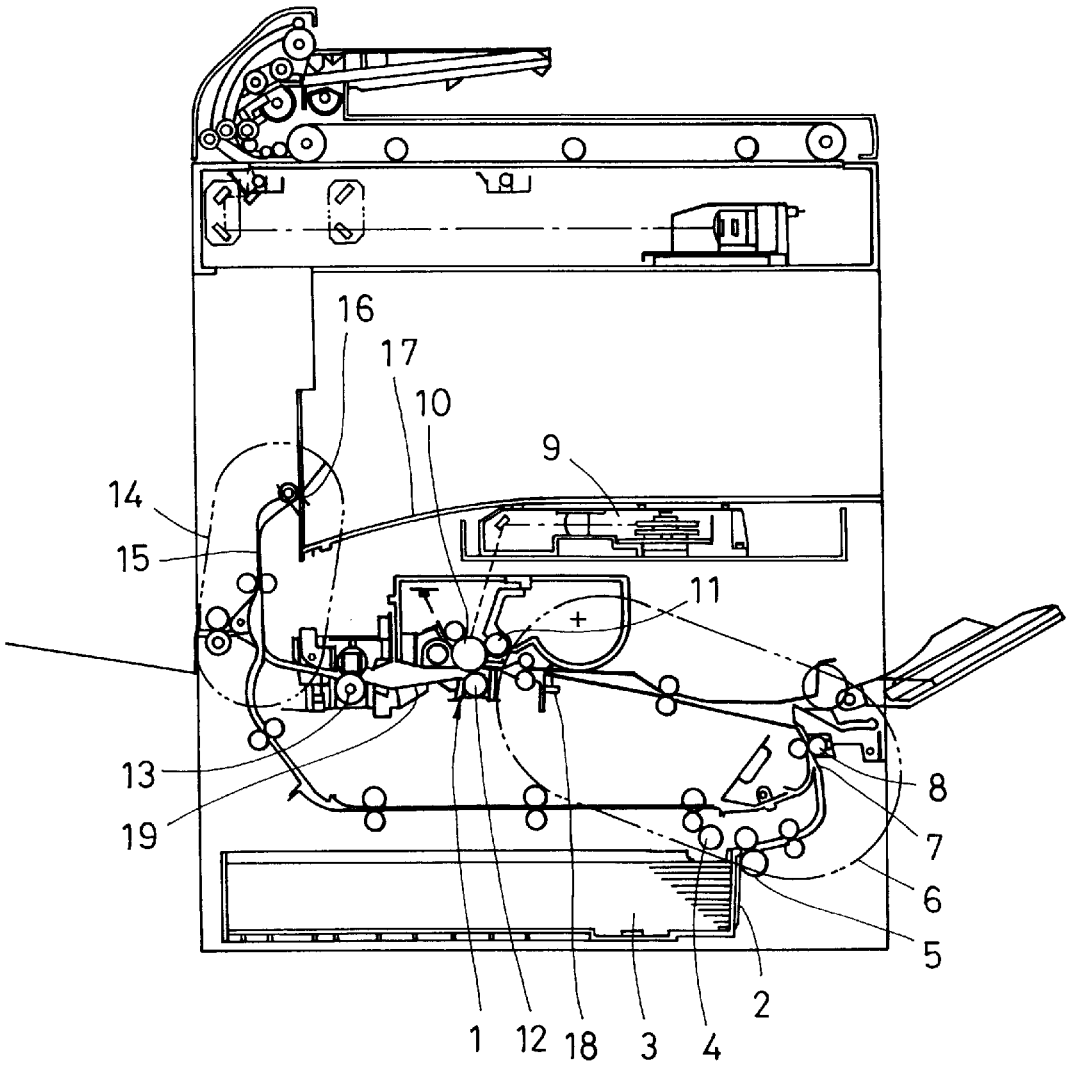
FIG. 7 PRIOR ART
FIG. 7 is a view schematically showing the construction of a conventional image forming apparatus.

FIG. 1 schematically shows the construction of a copying machine as one of image forming apparatus according to an embodiment of the present invention. Note that, in FIG. 1, the same numerals as in FIG. 7 denote the same or corresponding components.

Referring to FIG. 1, numeral 100 denotes a copying machine and 100A denotes a body of the copying machine. Numeral 22 denotes a reading unit which may serve as reading means for reading an original document (not shown) placed on a platen 21. Document information read by the reading unit 22 is sent to a laser scanner 9. In accordance with the document information, the laser scanner 9 illuminates light to the surface of a photoconductive drum 10 to form thereon an electrostatic latent image.

Numerals 6*a*, 6*b* denote feed rollers disposed in the paper supply transport section 6. A sheet of recording paper 3 is transported to an image forming section 1 by the feed rollers 6*a*, 6*b* and register rollers 8. Also, numeral denotes a manual paper supply section. A sheet of recording paper (not shown) manually inserted through the manual paper supply section 25 is transported to the image forming section 1 by the feed rollers 6*a*, 6*b* and a paper supply roller 26.

Numerals 14*a*, 14*b* denote feed rollers disposed in the paper ejection transport section 14. The recording paper 3, on which an image has been formed in the image forming section 1, is transported by the feed rollers 14*a*, 14*b* to a paper ejection roller 16 that serves as a paper ejecting means. Thereafter, the recording paper 3 is ejected by the paper ejection roller 16 onto a paper ejection tray 17 that is formed in a central area of the copying machine body 100A.

Figure 2:
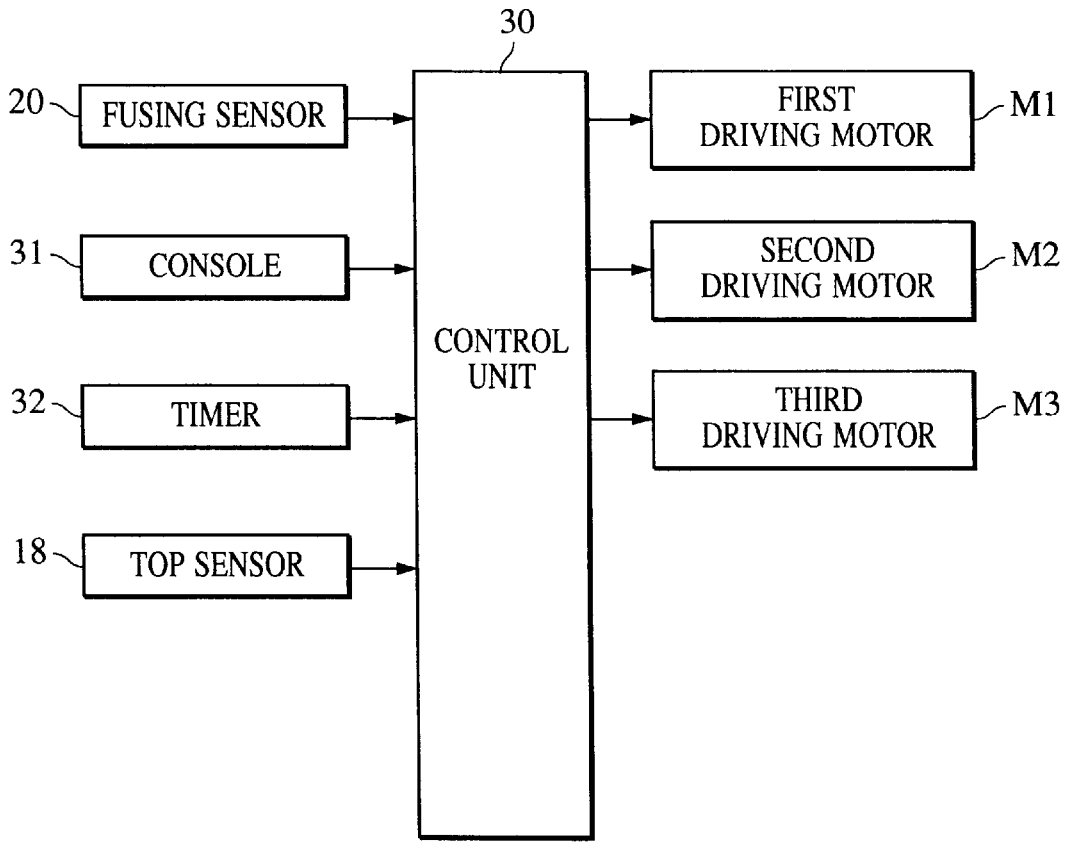
FIG. 2 is a control block diagram of the copying machine of FIG. 1.

Further, numeral 20 denotes a fusing sensor disposed downstream of a fusing station 13. The fusing sensor 20 is turned on upon detecting the leading end of the recording paper 3 on which a visible image has been fused and fixed in the fusing station 13, and is turned off after the tailing end of the recording paper 3 has passed the fusing sensor 20. An output of the fusing sensor 20 is applied to a control unit 30, shown in FIG. 2, provided at a predetermined position within the copying machine.

The control unit 30 serving as a speed control means detects the number of sheets of recording paper 3, on which images have been formed, in accordance with the output of the fusing sensor 20. Depending on the detected number of sheets having images recorded thereon, the control unit 30 controls rotations of a first driving motor M1 (FIG. 2) for driving the rollers 4, 5, 6*a*, 6*b*, 8 and 26 that constitute paper supply sheet transporting means of the paper supply transport section 6, a second driving motor M2 for driving the rollers 14*a*, 14*b* that constitute paper ejection sheet transporting means of the paper ejection transport section 14, and a third driving motor M3 for driving the paper ejection roller 16, thereby controlling the transport speed of the recording paper 3.

In this embodiment, stepping motors are used as the first to third driving motors M1, M2 and M3. The control unit 30 changes pulse commands to control the rotational speeds of the driving motors M1, M2 and M3 so that the transport speed of the recording paper 3 is controlled as intended. The use of stepping motors, whose speeds can be easily controlled just by changing pulse commands, eliminates the need of separately adding other mechanisms, such as drive gears and clutches, for changing the sheet transport speed, and is effective to avoid an increase of the cost.

When forming images on, e.g., 20 sheets of recording paper 3 successively, the control unit 30 rotates the first driving motor M1 and the second driving motor M2 in this embodiment such that the sheet transport speed in the paper supply transport section 6 and the paper ejection transport section 14 is the same as that in the image forming section 1, i.e., a process speed, until reaching the last sheet of recording paper 3.

Figure 3:
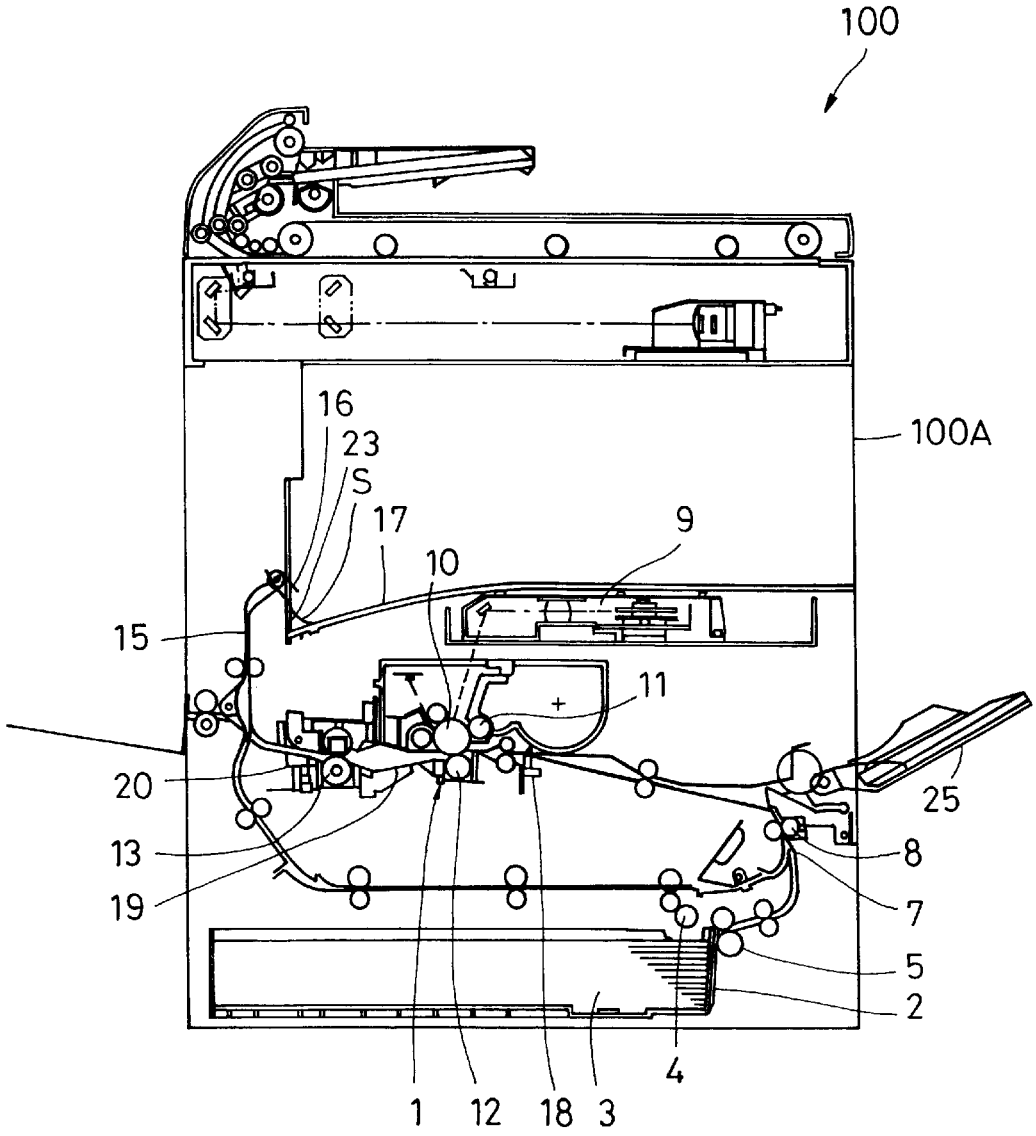
FIG. 3 shows a condition where a sheet of recording paper is incorrectly ejected in the copying machine of FIG. 1.

Also, at the time when the recording paper 3 is ejected by the paper ejection roller 16 to such an extent that a sheet rear portion of about 10 mm still has not yet passed the paper ejection roller 16, the control unit 30 controls the rotation of the third driving motor M3 to rotate the paper ejection roller 16 at a speed (referred to as a "double speed" hereinafter) twice the process speed. By rotating the paper ejection roller 16 at double speed, the tailing end of recording paper 3 is prevented from striking against wall 23 of paper ejection tray 17, as shown in FIG. 3.

On the other hand, when forming an image on the last sheet of recording paper 3, the control unit 30 rotates the first driving motor M1 and the second driving motor M2 after the start of paper supply such that the sheet transport speed in at least one of the paper supply transport section 6 and the paper ejection transport section 14, in both of them in this embodiment, is the speed twice the process speed for the purpose of improving productivity.

Furthermore, at the time when the control unit 30 receives a signal from the a top sensor 18, which indicates the detection of the recording paper 3, after doubling the sheet transport speed in the paper supply transport section 6, it rotates the first driving motor M1 such that the recording paper 3 is transported at the process speed for image formation. Then, when an off-signal is inputted from the fusing sensor 20, i.e., when the image formation is completed, the control unit 30 rotates the second driving motor M2 so as to double the transport speed of the recording paper 3 in the paper ejection transport section 14.

Figure 4A:
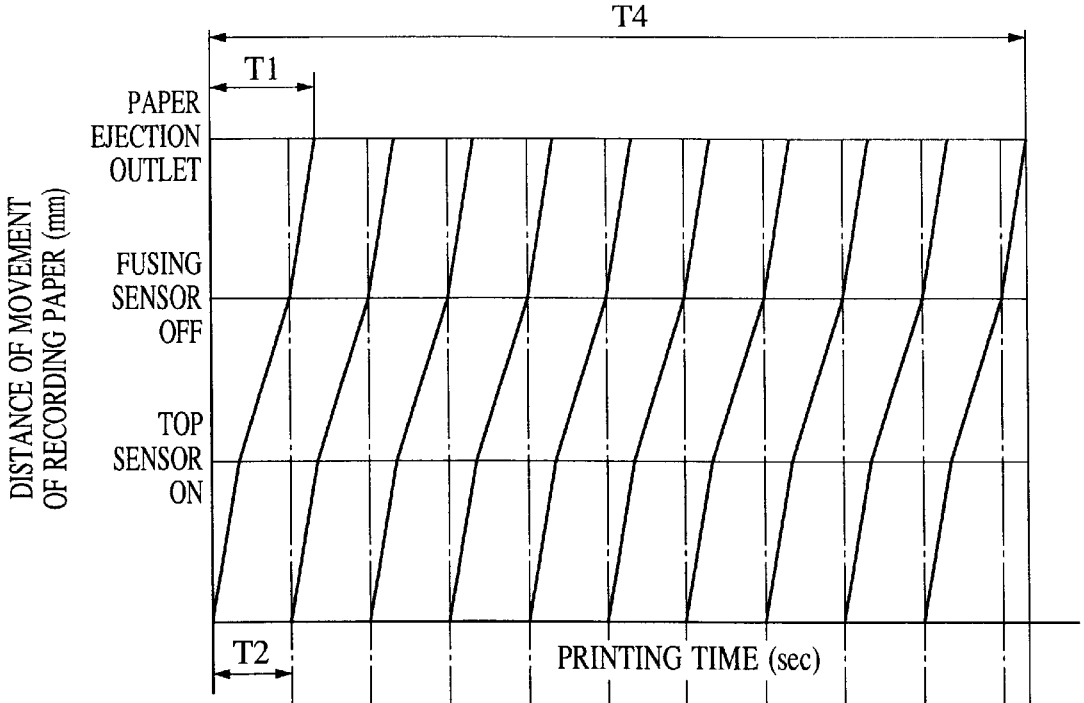
FIGS. 4A and 4B are charts for explaining the sheet transport operation in the related art and the copying machine of FIG. 1.
Figure 4B:
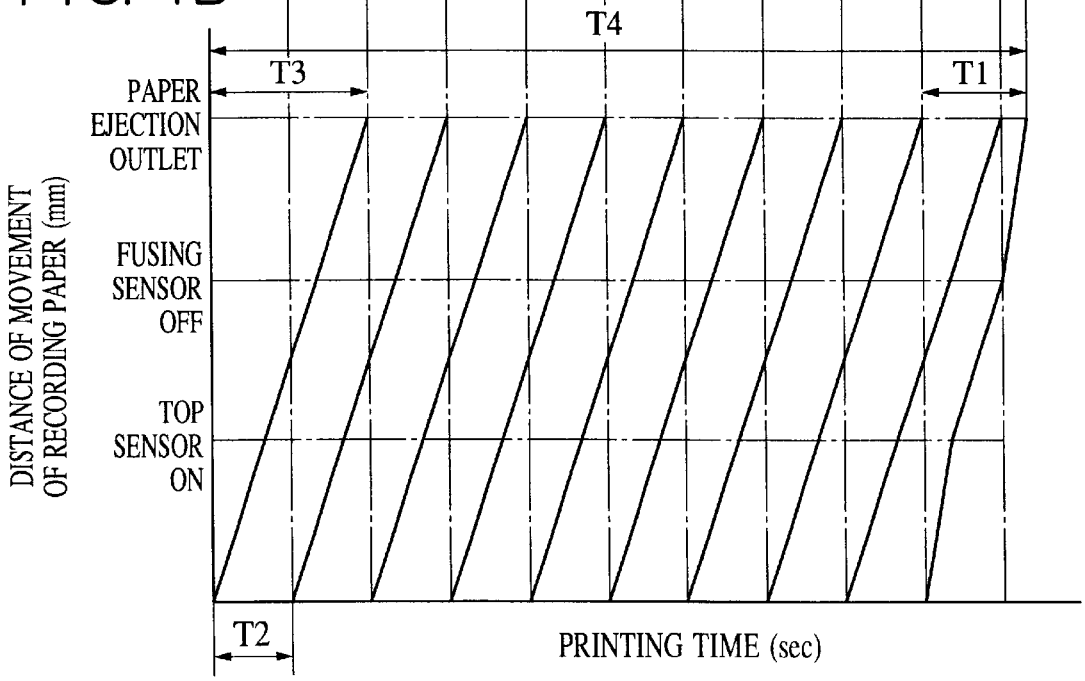

FIG. 4B is a chart for explaining the sheet transport operation in the copying machine 100 having the above-described construction. In the chart of FIG. 4B, the vertical axis represents the distance of movement of the recording paper 3 and the horizontal axis represents time. FIG. 4A represents the sheet transport operation in a conventional copying machine.

Comparing the transport operation of the recording paper 3 shown in FIG. 4B with that in the related art shown in FIG. 4A, a time T3 required for outputting one copy in this embodiment is longer than a time T1 required in the related art. This difference in copying time results from the fact that a characteristic line of the related art has a steeper gradient in two regions as shown in FIG. 4A, while a characteristic line of this embodiment has a uniform gradient as shown in FIG. 4B.

However, a time interval T2 for paper supply is the same between the related art and this embodiment whenever each copying machine has the same printing capability. Assuming specifications whereby sheets of recording paper are supplied at a rate of 20 sheets/min, for example, the sheets are supplied at the time interval T2 of 60 (seconds)/20 (sheets)=3 seconds per sheet in either case. As is understood from FIG. 4B, therefore, a total time T4 in this embodiment is the same as that in the related art by transporting with only the last sheet of recording paper 3 at a faster speed, i.e., in the same time as T1 in the related art. In the case of forming only one copy, the first sheet of recording paper is the last sheet of recording paper 3, and therefore the fast copying time is not reduced.

By controlling the sheet transport speed as described above, the need for transporting the recording paper 3 at an increased speed can be eliminated and the generation of noises can be prevented. Also, since the driving motors M1, M2 and M3 are no longer required to rotate at an increased speed, it is possible to prevent a temperature rise in the copying machine body due to heat generated by the driving motors M1, M2 and M3, and hence to avoid an adverse effect upon the image forming section 1.

Figure 5:
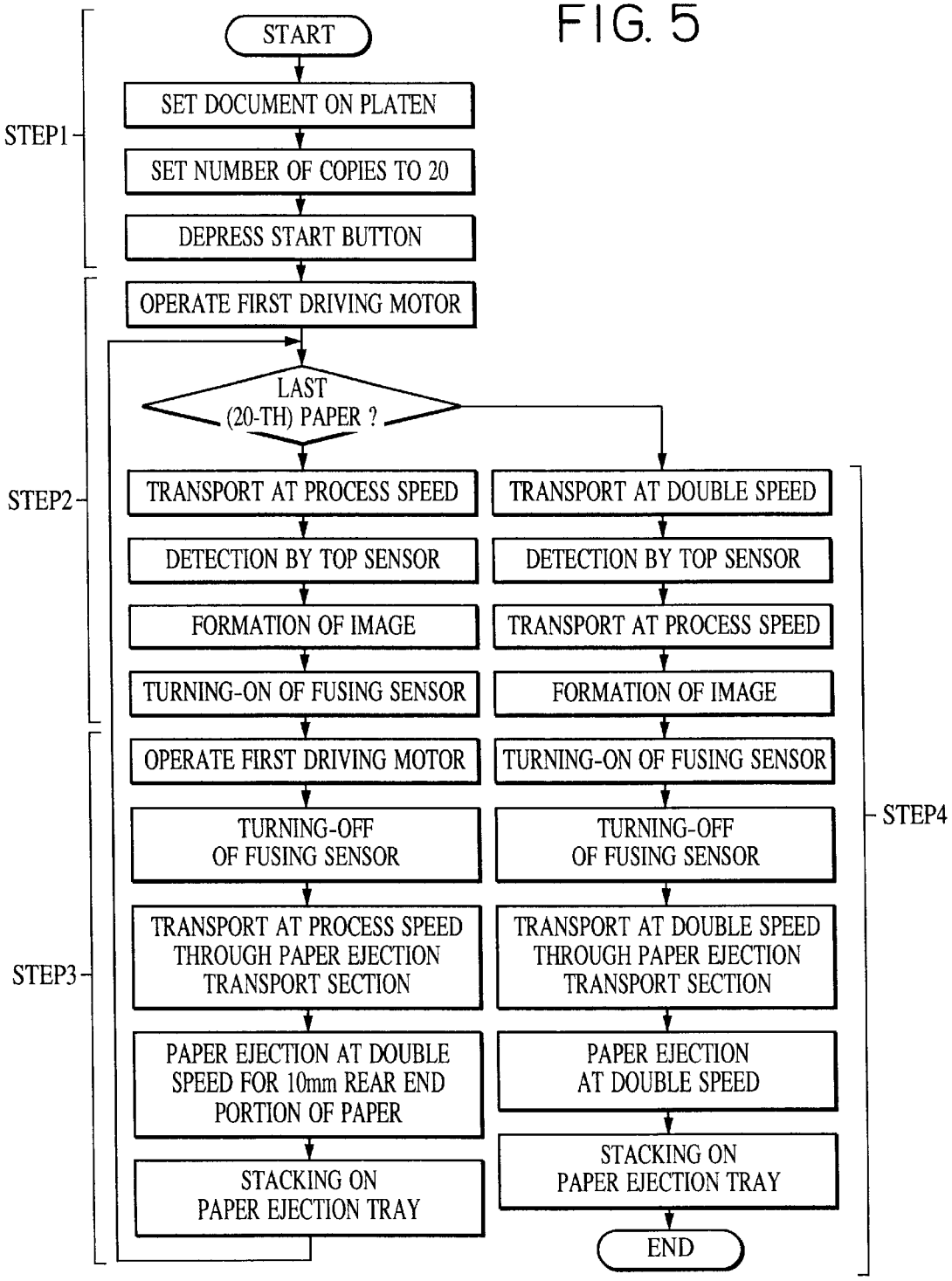
FIG. 5 is a flowchart for explaining transport speed control in the copying machine of FIG. 1.

The transport speed control of the copying machine 100 having the above-described construction will be described below with reference to a flowchart of FIG. 5. Herein, a description is made of, by way of example, the operation in the case of copying images on 20 sheets of recording paper 3 successively.

First, in STEP 1, an operator sets an original document on the platen 21 shown in FIG. 1, and sets the number of copies to 20 by entering a numeral 20 through a key-in section (not shown) provided in a console 31 shown in FIG. 2. Then, the operator depresses a start button to start the copying operation.

In STEP 2, when the start button is depressed, the control unit 30 determines whether the recording paper 3 is the last sheet of recording paper, i.e., whether it is the 20-th sheet. If it is determined that the recording paper 3 is the last sheet of recording paper, the control unit 30 controls the rotation of the first driving motor M1 so that the sheet transport speed through the pickup roller 4, the separator 5, the register rollers 8, and the feed rollers 6*a*, 6*b* is the same as the process speed.

Subsequently, the recording paper 3 is transported at such a transport speed, and when the recording paper 3 is detected by the top sensor 18 disposed immediately upstream of the image forming section 1, the control unit 30 controls the process of image formation in sync with image information. At this time, the sheet transport speed remains at the process speed. Thereafter, the fusing sensor 20 is turned on while the image formation is continued. If no jam is detected, the control unit 30 rotates the first driving motor M1 so that the pickup roller 4 automatically starts operation at 3 seconds after the start of the preceding paper supply cycle, thereby supplying a next sheet of recording paper. In such a sequence, time management is carried out using a timer 32 shown in FIG. 2.

In STEP 3, after completion of the image formation including the fusing process, at the time when the tailing end of the recording paper 3 introduced to the paper ejection transport section 14 passes the fusing sensor 20, the fusing sensor 20 is turned off. Upon the fusing sensor being turned off, the control unit 30 controls the rotation of the second driving motor M2 so that the sheet transport speed through the feed rollers 14*a*, 14*b* in the paper ejection transport section 14 is the same as the process speed.

Then, at the time when the recording paper 3 having been fed through the paper ejection transport section 14 at the process speed is ejected onto the paper ejection tray 17 by the paper ejection roller 16 to such an extent that a sheet rear portion of about 10 mm has not yet passed the paper ejection roller 16, the control unit 30 rotates the third driving motor M3 such that the sheet transport speed becomes twice the process speed.

Hence, as described above, the tailing end of the recording paper 3 is ejected onto the paper ejection tray 17 without striking against the wall 23 of the paper ejection tray 17 as shown in FIG. 3. The timing of increasing the sheet transport speed in such a sequence is also determined under the time management using the timer 32.

In STEP 4, the above-described copying operation is repeated, and when the last 20-th sheet of recording paper 3 is finally reached, the control unit 30 controls the rotation of the first driving motor M1 after the start of paper supply so that the sheet transport speed is doubled until the top sensor 18 detects the recording paper 3, for the purpose of reducing a time necessary for the job of printing 20 copies, i.e., improving productivity.

Subsequently, when the recording paper 3 is detected by the top sensor 18, the control unit 30 controls the process of image formation in sync with image information. At this time, the sheet transport speed is reduced to the process speed for the image formation. Then, when the fusing sensor 20 is turned off, i.e., when the image formation is completed, the control unit 30 controls the rotation of the second driving motor M2 so as to double the sheet transport speed in the paper ejection transport section 14.

Thereafter, the recording paper 3 is ejected onto the paper ejection tray by the paper ejection roller 16. In this case, when the recording paper 3 is ejected by the paper ejection roller 16, the sheet transport speed in the paper ejection transport section 14 is already doubled. Therefore, the paper ejection roller 16 ejects the recording paper 3 onto the paper ejection tray without changing its rotational speed for a rear end portion of the recording paper 3.

Thus, in the case of outputting copies successively, the continuous copying operation can be performed with less noise and without reducing productivity by increasing the transport speed of only the last sheet of recording paper 3, i.e., by avoiding the unnecessary increased transporting speed of sheets of recording paper 3.

Also, by increasing the sheet transport speed not in the paper supply transport section 6 alone, but in both of the paper supply transport section 6 and the paper ejection transport section 14, noise is reduced over an entire paper path and hence a quieting effect is achieved.

Further, since the driving motors M1, M2 and M3 are not required to rotate at the increased speed unnecessarily, heat generation from the driving motors M1, M2 and M3 can be suppressed. It is therefore possible to prevent an adverse effect upon the image forming section 1 resulting from a temperature rise in the copying machine body, and an increase of the cost resulting from the necessity of a cooling fan, etc.

Moreover, as shown in FIG. 1, the transport path in the paper supply transport section 6 is generally introduced to the register rollers 8 while passing the curved reversing guide 15 immediately after exiting the cassette 2.

The register rollers 8 are essential to correct a skew of the recording paper 3 before it enters the image forming section 1, and to adjust the image write timing.

Figure 6:
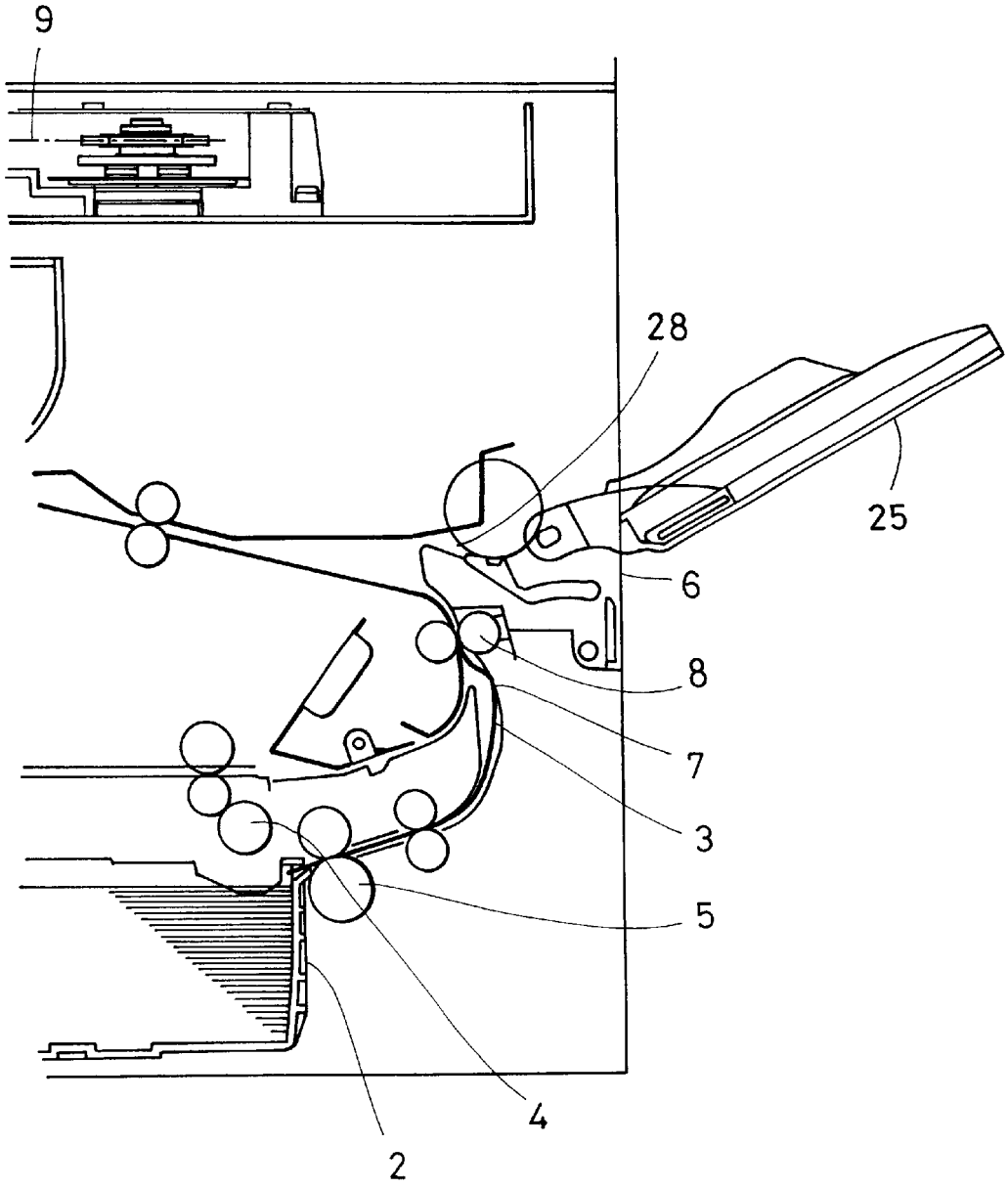
FIG. 6 is a view for explaining the registering operation in a paper supply transport section.

Although the register rollers 8 are essential in the transport path in the paper supply transport section 6, the recording paper 3 strikes against the register rollers 8 at a standstill, as shown in FIG. 6, when the recording paper 3 is registered. From the viewpoint of operating noises, therefore, a higher transport speed in the paper supply transport section 6 increases the sound generated upon buckling of the recording paper 3 itself, the sound generated upon the recording paper 3 striking against the inverting guide 7 after being buckled, and the sound generated upon the recording paper 3 frictionally sliding over the reversing guide 7 when the recording paper 3 moves again after forming a loop while it is pressed against the surface of the reversing guide 7 under resiliency of the loop.

Additionally, in most cases, the paper supply transport section 6 includes the manual paper supply section 25 for manual paper supply midway in the transport path, as shown in FIG. 1. In this arrangement, sounds such as one generated upon the sheet registration are apt to leak to the outside through a paper supply opening 28.

Stated otherwise, the paper supply transport section 6 has an arrangement including many noise sources such as the register rollers, and causing sounds to easily leak through the opening for the manual paper supply section. Therefore, increasing the transport speed of only the last sheet of recording paper 3 in the paper supply transport section 6, as one feature of the present invention, is very effective to suppress such noise.

More specifically, the copying machine 100 of this embodiment includes the curved reversing guides 7, 15 as shown in FIG. 1. When the recording paper 3 passes the curved reversing guides 7, 15, sounds are generated due to frictionally sliding of the recording paper 3 over the curved reversing guides 7, 15 and are increased especially in the case of using the recording paper 3 that has strong rigidity or is recycled paper having a rough surface.

However, even those noises can be reduced by increasing the transport speed of only the last sheet of recording paper 3.

While only the last sheet of recording paper 3 is sped up in the description set forth above, the present invention is not limited to such an embodiment and the first sheet of recording paper 3, for example, may be sped up instead of the last sheet of recording paper 3.

Speeding up the first sheet of recording paper 3 is advantageous in enabling errors, such as a copying error and other errors in density contrast and size, to be earlier found. By depressing a stop key at once upon confirmation of such an error, the number of wasted sheets of recording paper 3 can be minimized.

Further, as shown in FIG. 1, the copying machine 100 of this embodiment includes a re-transport section 27 for transporting the recording paper 3 back to the image forming section 1 to form an image on the other side of the recording paper 3, on one side of which an image has been already formed, for the purpose of duplex recording.

When performing duplex recording, the recording paper 3, on one side of which an image has been already formed, is first transported to the paper ejection transport section 14. Then, the feed roller 14*a* is rotated backward to advance the recording paper 3 into the re-transport section 27. Subsequently, the recording paper 3 is sent back to the paper supply transport section 6 by feed rollers 27*a*, 27*d*, which serve as re-transport sheet transporting means and is disposed in the re-transport section 27, and then transported to the image forming section 1.

In such a process of forming images on both sides of the recording paper 3, at least one of the sheet transport speeds in the paper supply transport section 6, the paper ejection transport section 14, and the re-transport section 27, e.g., all of those sheet transport speeds in this embodiment, is increased to twice the process speed but only when an image is formed on the other surface of the last sheet of the recording paper 3. As a result, a reduction of noises can be realized.

While the copying machine 100 includes one stage of cassette 2 in the foregoing embodiment, the present invention is not limited to such an arrangement, and similar advantages can also be obtained by making similar control in a copying machine provided with a plurality of cassettes. Stated otherwise, in a copying machine including a plurality of cassettes 2, similar advantages can be obtained by controlling the transport speed of the recording paper 3 until reaching the image forming section 1 from a paper supply opening of each of the cassettes. This is equally applied to the transport of the recording paper 3 from the manual paper supply section 25. It is thus essential that the sheet transport speed in the paper supply transport section 6 from each paper supply section to the image forming section 1 be controlled.

Further, while the transport speed is increased for the last sheet of recording paper 3 or the first sheet of recording paper 3 in the foregoing description, the transport speeds may be increased for both of the last sheet and the first sheet, and the sheet of recording paper 3, which should be sped up, may be set depending on the preference of users. Also, frequency of the speed control may be changed depending on the type of recording paper 3. Thus, in the case of using thick paper or recycled paper that is apt to cause noises, only the last sheet of recording paper 3 may be transported at the double speed. Further, the image forming section 1 may be of the type of, e.g., bubble jet, thermal transfer, and dot impact. It is just essential that the image forming section 1 is able to record an image on a sheet of recording paper transported through it.

The embodiment has been described as speeding up the recording paper for its rear end portion of 10 mm when the recording paper is ejected at the process speed. However, the transport speed may be optionally adjusted to a proper value for the rear end portion of the recording paper depending on alignment of sheets ejected in the stacked form.

More specifically, for example, when the recording paper 3 is overly ejected in the speed-up ejection mode, or when the paper ejection tray 17 has a specific shape, the recording paper 3 may be ejected at the same speed when it is transported at the process speed, and the transport speed of the recording paper 3 may be reduced for the rear end portion of 10 mm when ejected at the double speed. By thus controlling the paper ejection by the paper ejection roller 16 so as to eject the sheet of recording paper 3 at a predetermined ejection speed regardless of the paper ejection transport section 14, it is possible to improve alignment of the stacked sheets of recording paper 3 and operability in taking out and putting the sheets in order.

According to the present invention, as has been described above, the occurrence of noises can be suppressed without reducing productivity by controlling the sheet transport speed of at least one of sheet transporting means provided in the paper supply transport section and the paper ejection transport section to be higher than that in the image forming section when an image is formed on a predetermined sheet.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus comprising an image forming section, a sheet supply transport section for transporting a sheet to the image forming section, and a sheet ejection transport section for transporting the sheet, on which the image has been formed in said image forming section, said apparatus further comprising:

sheet supply transporting means for transporting sheets in said sheet supply transport section;

sheet ejection transporting means for transporting sheets in said sheet ejection transport section; and speed control means for controlling sheet transport speeds of said sheet supply transporting means and said sheet ejection transporting means, wherein said speed control means sets the sheet transport speed of at least one of said sheet supply transporting means and said sheet ejection transporting means during transportation of at least one of the last sheet and the first sheet of sequential sheets on which images are formed higher than the transport speed of another sheet of said sequential sheet.

2. An image forming apparatus according to claim 1, wherein said speed control means sets the higher transport speed on at least one of said sheet supply transporting means and said sheet ejection transporting means during transportation of at least one of the last sheet and the first sheet of sequential sheets on which images are formed are formed higher than the transport speed in the image forming section.

3. An image forming apparatus according to claim 1, wherein each of said sheet supply transporting means and said sheet ejection transporting means is driven by a stepping motor, and said speed control means controls the sheet transport speed of said sheet supply transporting means and said sheet ejection transporting means by controlling said stepping motors.

4. An image forming apparatus according to claim 1, wherein at least one of said sheet supply transport section and said sheet ejection transport section includes a curved sheet transport path.

5. An image forming apparatus according to claim 1, further comprising:

a re-transport section for transporting a sheet, on one side of which an image has been formed, back to said image forming section for forming an image on the other side of said sheet having the image formed on one side thereof; and re-transport sheet transporting means for transporting the sheet in said re-transport section back to the image forming section, said speed control means controlling the sheet transport speed of at least one of said re-transport sheet transporting means, said sheet supply transporting means and said sheet ejection transporting means to be higher than a sheet transporting speed in said image forming section during transportation of a predetermined sheet for image formation on the other side of said predetermined sheet.

6. An image forming apparatus according to claim 1, wherein sheet ejecting means for ejecting a sheet from said sheet ejection transport section is provided in said paper ejection transport section, and said speed control means controls said sheet ejecting means to eject the sheet at a predetermined sheet ejection speed regardless of a sheet transport speed of said sheet ejection transporting means.

7. An image forming apparatus comprising:

an image forming section;

a sheet supply transport section for transporting a sheet to said image forming section;

sheet supply transporting means for transporting sheets in said sheet supply transport section; and speed control means for controlling a sheet transport speed of said sheet supply transporting means, wherein said speed control means controls said sheet supply transporting means so that the sheet transport speed of at least one of the last sheet and the first sheet of sequential sheets on which images are formed is higher than the sheet transport speed of another sheet of said sequential sheet.

8. An image forming apparatus comprising:

feed rollers for transporting sheets;

a photoconductive drum on which an electrostatic latent image is formed, wherein said electrostatic latent image is developed into a visible image and transferred to a sheet transported by said feed rollers;

an ejection roller for ejecting the sheets on which the visible images on said photoconductive drum are transferred; and a control unit for controlling the sheet transport speed of said feed rollers so that the sheet transport speed of at least one of the first sheet and the last sheet of sequential sheets is higher than the transport speed of another sheet of said sequential sheet.

9. An image forming means according to claim 8, wherein said control unit controls the sheet transport speed of said feed rollers so that the sheet transport speed of at least one of the first sheet and the last sheet of sequential sheets transferred by said feed rollers is higher than the sheet transport speed during transference of the visible image at said photoconductive drum.

10. An image forming apparatus according to claim 8 or claim 9, wherein said feed rollers are driven by a stepping motor, and said control unit controls the sheet transport speed of said feed rollers by controlling said stepping motor.

11. An image forming apparatus comprising:

first feed rollers for transporting sheets;

a photoconductive drum on which an electrostatic latent image is formed, wherein said electrostatic latent image is developed into a visible image and transferred to a sheet transported by said first feed rollers;

second feed roller for transporting the sheets on which the visible images on said photoconductive drum are transferred;

ejection roller for ejecting the sheets transported by said second feed roller; and control unit for controlling the sheet transport speed of said second feed rollers so that the sheet transport speed of at least one of the first sheet and the last sheet of sequential sheets transferred by said second feed roller is higher than the transport speed of another sheet of said sequential sheet.

12. An image forming means according to claim 11, wherein said control unit controls the sheet transport speed of said second feed roller so that the sheet transport speed of at least one of the first sheet and the last sheet of sequential sheets transferred by said second feed roller is higher than the sheet transport speed during transference of the visible image at said photoconductive drum.

13. An image forming apparatus according to one of claim 11 or claim 12, wherein said second feed roller is driven by a stepping motor, and said control unit controls the sheet transport speed of said second feed roller by controlling said stepping motor.

14. An image forming apparatus comprising:

feed rollers for transporting sheets;

a photoconductive drum on which an electrostatic latent image is formed, wherein said electrostatic latent image is developed into a visible image and transferred to a sheet transported by said feed rollers;

ejection roller for ejecting the sheets on which the visible images on said photoconductive drum are transferred; and control unit for controlling the sheet transport speed of said feed rollers so that said feed rollers transport at least one of the first sheet and the last sheet of sequential sheets at a first speed, and said feed rollers transport another sheet of said sequential sheet at a second speed, wherein said first speed is higher than said second speed.

15. An image forming means according to claim 14, wherein said first speed is higher than the sheet transport speed during transference of the visible image at said photoconductive drum.

16. An image forming apparatus according to claim 14 or claim 15, wherein said feed rollers are driven by a stepping motor, and said control unit controls the sheet transport speed of said feed rollers by controlling said stepping motor.

17. An image forming apparatus comprising:

first feed rollers for transporting sheets;

a photoconductive drum on which an electrostatic latent image is formed, wherein said electrostatic latent image is developed into a visible image and transferred to a sheet transported by said first feed rollers;

second feed roller for transporting the sheets on which the visible images on said photoconductive drum are transferred;

ejection roller for ejecting the sheets transported by said second feed roller; and control unit for controlling the sheet transport speed of said second feed rollers so that said second feed roller transports at least one of the first sheet and the last sheet of sequential sheets at a first speed, and said second feed roller transports another sheet of said sequential sheet at a second speed, wherein said first speed is higher than said second speed.

18. An image forming means according to claim 17, wherein said first speed is higher than the sheet transport speed during transference of the visible image at said photoconductive drum.

19. An image forming apparatus according to one of claim 17 or claim 18, wherein said second feed roller is driven by a stepping motor, and said control unit controls the sheet transport speed of said second feed roller by controlling said stepping motor.

* * * * *

UNITED STATES PATENT AND TRADEMARK OFFICE

CERTIFICATE OF CORRECTION

PATENT NO. : 6,526,254 B2
DATED : February 25, 2003
INVENTOR(S) : Jiro Futagawa

It is certified that error appears in the above-identified patent and that said Letters Patent is hereby corrected as shown below:

Column 1,
Line 65, “that” should read -- than --.

Column 2,
Line 25, “raise” should read -- raises --.

Column 4,
Line 18, “numeral” should read -- numeral 25 --.

Column 5,
Line 25, “the a” should read -- the --.

Column 10,
Line 15, “are formed” (2nd occurrence) should be deleted.

Column 11,
Lines 15 and 44, “means” should read -- apparatus --.
Line 39, “rollers” should read -- roller --.

Column 12,
Lines 18 and 45, “means” should read -- apparatus --.
Line 39, “rollers” should read -- roller --.
Line 49, “one of” should be deleted.

Signed and Sealed this

Eleventh Day of November, 2003

JAMES E. ROGAN
*Director of the United States Patent and Trademark Office*